United States Patent [19]

Parry et al.

[11] Patent Number: 4,772,059

[45] Date of Patent: Sep. 20, 1988

[54] CARRYING MEMBER

[76] Inventors: Bernard Parry, 3565 The Credit Woodlands, Mississauga, Ontario, Canada, L5C 2K8; Raymond Young, 3455 Glen Erin Drive, Ste. 1506, Mississauga, Ontario, Canada, L5L 2G2

[21] Appl. No.: 3,313

[22] Filed: Jan. 14, 1987

[51] Int. Cl.[4] ..... B65D 33/06

[52] U.S. Cl. ..... 294/170; 294/158; 383/13

[58] Field of Search ..... 294/137, 141–143, 294/145, 148, 149, 151, 153, 154, 158, 159, 162–167, 170, 171; 383/6, 13, 15, 25, 26, 29

[56] References Cited

U.S. PATENT DOCUMENTS

| | | | |
|---|---|---|---|
| 1,064,917 | 6/1913 | Korter | 294/169 |
| 2,612,308 | 9/1952 | Potts | 294/170 X |

FOREIGN PATENT DOCUMENTS

| | | | |
|---|---|---|---|
| 558835 | 6/1958 | Canada | 383/13 |
| 923470 | 3/1973 | Canada | 294/158 |
| 7888 | 2/1980 | European Pat. Off. | 294/137 |
| 1174228 | 7/1964 | Fed. Rep. of Germany | 294/158 |
| 81/03008 | 10/1981 | World Int. Prop. O. | 383/13 |
| 224527 | 3/1943 | Switzerland | 294/170 |
| 21505 | of 1913 | United Kingdom | 294/137 |
| 113180 | 2/1918 | United Kingdom | 294/158 |
| 432477 | 7/1935 | United Kingdom | 294/170 |

*Primary Examiner*—Johnny D. Cherry

[57] ABSTRACT

The present invention provides a carrying member for carrying items such as grocery bags and parcels which have uncomfortable pressure producing handles with the carrying member being designed to alleviate that pressure and comprising an upper pressure distributing gripping portion and a lower handle receiving region having an access opening for fitting the bag handles onto the handle receiving region which is further provided with a handle restraint for preventing the handles from then inadvertently falling back through the access opening.

1 Claim, 2 Drawing Sheets

CARRYING MEMBER

FIELD OF THE INVENTION

The present invention relates to a carrying member or carrying handle for use in carrying one or more grocery bags or the like.

BACKGROUND OF THE INVENTION

As will be appreciated by anyone who has had to carry conventional grocery bags the handles on these bags tend to dig into ones hand making them particularly uncomfortable particularly when holding onto more than one bag. Often times people will try to carry a number of bags in both hands which is not only painful but is additionally awkward since the handles are orientated relative to the bags such that they must be carried sideways in a position that interferes with walking. Furthermore, if one has to put the bags down, to open a door or when loading them into the trunk of a car or the like, the bags tend to fall over spilling their contents and are difficult to regather.

SUMMARY OF THE PRESENT INVENTION

The present invention provides a carrying member designed to overcome the problems described above. More specifically the carrying member of the present invention, which is used for carrying and alleviating pressure from items such as grocery bags and the like having pressure producing handles, comprises an upper pressure distributing gripping portion and a lower handle receiving region having an access opening for fitting the handles onto the handle receiving region with restraining means to prevent the handles from inadvertently falling back through the access opening.

The gripping portion, due to its surface area which is substantially greater than that of the individual bag handles, provides a much better weight distribution across ones hand enabling a comfortable carrying of a relatively large number of bags at one time. Furthermore, all of the bags are effectively locked on the carrying member which can be put down and picked up without losing any of the bags or spilling of their contents.

BRIEF DISCUSSION OF THE DRAWINGS

The above as well as other advantages and features of the present invention will be described in greater detail according to the preferred embodiments of the present invention in which.

DETAILED DESCRIPTION OF THE PREFERRED EMBODIMENTS

Figure 1:
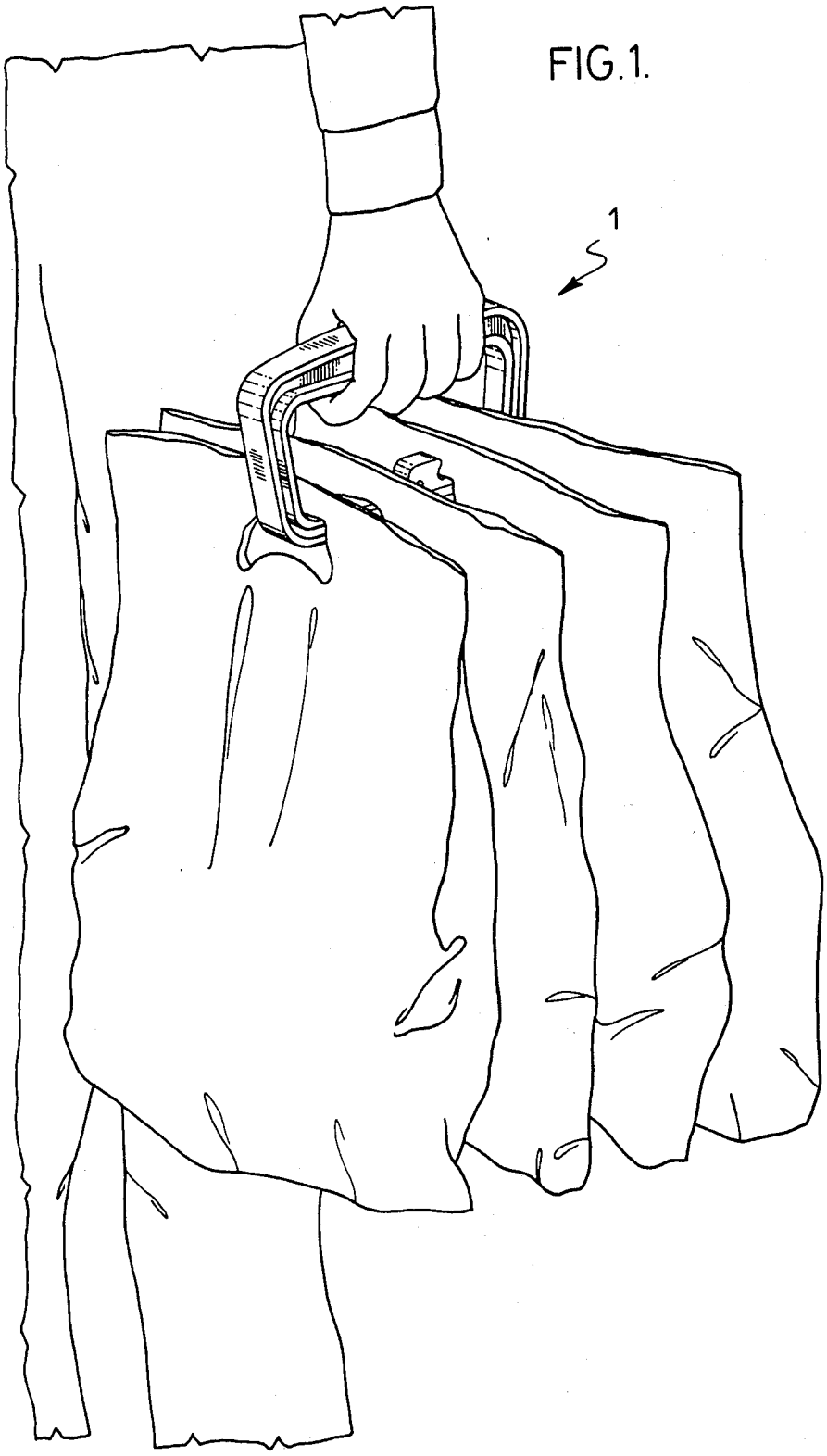
FIG. 1 is a perspective view showing the use of a carrying member for carrying a plurality of grocery bags according to a preferred embodiment of the present invention.
Figure 2:
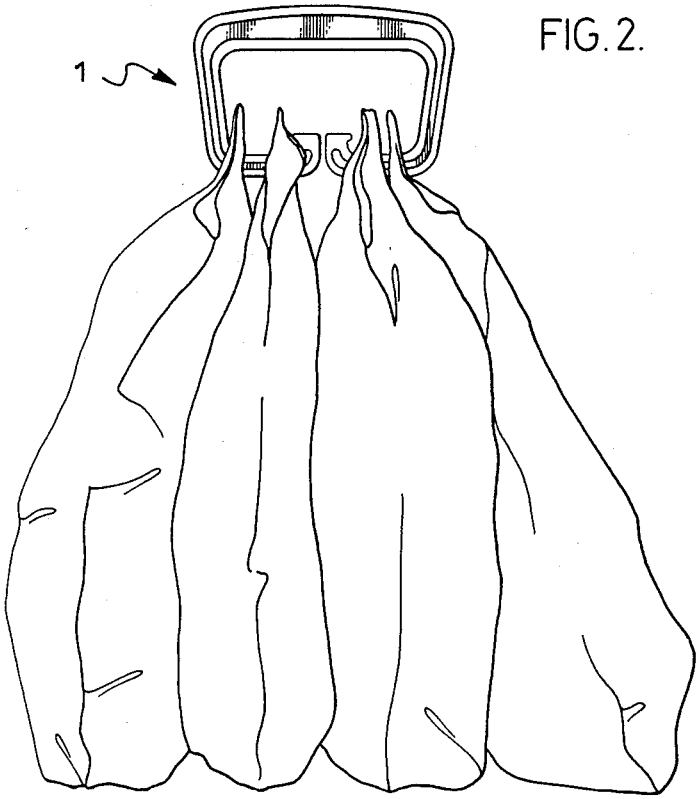
FIG. 2 is a side view showing the handle and grocery bags of FIG. 1 when laid down on a supporting surface.

FIGS. 1 and 2 show the use of a carrying member, generally indicated at 1 for comfortably carring a number of grocery bags at one time. Not only does the carrying member substantially reduce the otherwise uncomfortable pressure of carrying the bags but in addition changes the orientation of the bags from a normal side to side positioning when not using the carrying member to a front to back positioning where the bags do not interfere with walking when using the carrying member of the present invention.

Figure 3:
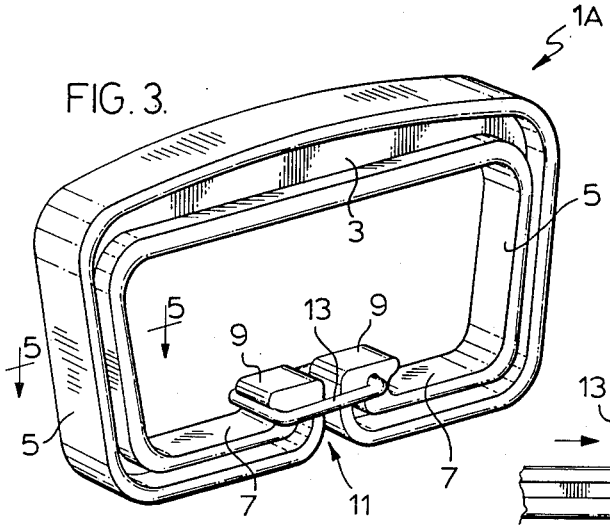
FIG. 3 is an enlarged perspective view of a carrying member according to a further preferred embodiment of the present invention.

FIG. 3 shows, in detail, the various parts of a carrying member, generally indicated at 1*a*. This particular carrying member is substantially identical to the carrying member of FIGS. 1 and 2 with the exception that it includes a specific means at the access to the handle receiving region of the carrying member and to be described later in detail.

Figure 5:
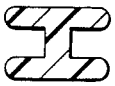
FIG. 5 is a cross-sectional view along the lines 5—5 of FIG. 3.
Figure 4:
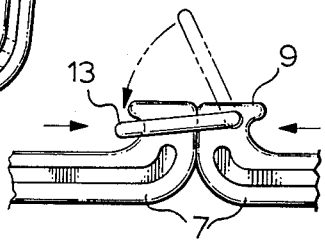
FIG. 4 is an enlarged view of the handle access and closure from the handle receiving region of the carrying member of FIG. 3.

The carrying member 1*a* of FIGS. 3 through 5 comprises a gripping or holding portion 3, the ends of which continue into outside portions 5 extending downwardly to a lower bag handle receiving region. This receiving region comprises a pair of support arms 7 spaced well beneath and substantially parallel to the upper gripping portion. The support arms 7 are separated from one another by a gap generally indicated at 11 midway along the handle. Each of the support arms is then provided with an upwardly extending hook like portion 9 facing inwardly relative to gap 11.

The loading of the bags is quickly and easily accomplished by simply slipping the bag handles up through gap 11 and fitting them onto support arms 7. When carrying a number of bags it is best to set them up balanced as shown in FIG. 2 with an equal number of bag handles on each support arm. When carrying only a single bag it may be preferable to separate the individual handle portions of that bag and fit them individually on the two support arms thereby balancing the load at the middle of the carrying member.

The width of gap 11 is such that it provides more than adequate clearance for fitting the bag handles up onto the bag handle receiving region with hook portions 9 preventing the bag handle from inadvertently slipping or falling back through the gap. Therefore, not only does the carrying member give a much more comfortable and even weight distribution for the bag handles but also provides a handle lock enabling all of the bags to be put down as again seen in FIG. 2 without them tipping over or spilling their contents. When picking the bags back up again one does not have to regather the individual handles but simply picks the entire load up by the carrying member where the bag handles remain trapped.

As a further preferred feature, the carrying member may be provided with a clasp 13 which can be releasably locked at the access opening to the bag handle receiving region to totally eliminate the possibility of a bag handle falling back through gap 11. This clasp may be constructed and arranged in many different ways with FIGS. 3 and 4 showing a specific embodiment whereby the clasp 13 is fitted through one of the hook portions 9 for a pivoting motion to lock over the other of the hook portions. In this particular embodiment clasp 13 is made of an elasticized material allowing its stretching into and out of the locking position.

Both the carrying members 1 and 1*a* are designed with maximum efficiency in mind. From a portability standpoint they are about the size of a package of cigarettes and can be easily carried in one's pocket or purse. Both members are preferably injection molded in a polypropylene material with an approximate weight of about 50 grams. One of the factors in keeping the carrying member extremely strong at this relatively light weight is its "I" beam construction as seen in FIG. 5 of the drawings.

As a result of its extremely strong construction the carrying member is capable of supporting any load that would normally be placed on it. However, in the event that there is a downward deflection of either of the support arms the overall arrangement is such that the support arms will not bend downwardly but rather will bind on one another and close gap 11 as shown in FIG. 4 of the drawings. This occurs because the downward extensions 5, rather than being perpendicular to the gripping portion, are angled slightly inwardly whereby any cantilever type movement of the individual support arms causes them to bend not only downwardly but also inwardly towards the other support arm. Accordingly even if subjected to a heavy enough load neither arm will bend downwardly past the other support arm. Also the downward inward angling of extensions 5 results in a shorter arm length for each of the support arms, further adding to their resistance to bending while the extensions 5 are themselves reinforced to prevent outward deflection thereby ensuring the proper gapping between the support arms.

Again, from a practical standpoint the entire carrying member is, as best seen in FIG. 5, rounded at all of its outside edges thereby further adding to its comfort in the hand contact area and also substantially reducing the likelihood of cutting into or damaging the handles of the shopping bags.

It will now be seen from the description above that the present invention provides a carrying member for receiving and comfortably carrying grocery bags and or other parcels having the type of handle that will otherwise bite into one's hand. Furthermore, the carrying member acts as a locking device for keeping a plurality of bags held together as a group so that they can be put down when loaded into the trunk of an automobile or when opening a door. The method of loading the bags onto the carrying member is extremely simple while the retaining means in the form of either a straight hook-like projection or a combination hook-like projection and clasp will effectively prevent the bag handles from falling off the carrying member. The "I" beam construction with its rounded corners makes the carrying member strong, light in weight and adds to the comfort with which it can be carried.In addition the carrying member has been designed so that the opening between the gripping region and the bag handle receiving region will receive a gloved hand enabling use of the carrying member in both summer and winter weather.

Although various preferred embodiments of the invention have been described herein in detail, it will be appreciated by those skilled in the art that variations may be made without departing from the spirit of the invention or the scope of the appended claims.

The embodiments of the invention in which an exclusive property or privilege is claimed are defined as follows:

1. A carrying member for carrying plastic bags by and alleviating pressure from the handles of the bags, said carrying member comprising an upper pressure distributing gripping portion, a pair of side arms, one at each end of said gripping portion, said side arms extending down to a pair of bag handle receiving support arms beneath said gripping portion, said support arms having upwardly hooked ends separated from one another by a bag handle passage to said support arms, said bag handle passage having a wide opening bottom and a narrower upper channel which, when said support arms are free of load, is completely open through said hooked ends of said support arms, said side arms being downwardly inwardly angled between said upper gripping portion and said support arms which are in turn parallel to said gripping portion and said side arms being reinforced to resist outward deflection such that under load any bending occurs at said support arms prior to said side arms with said hooked ends of said support arms being separated by a distance so as to bind on one another and close said bag handle passage in the event of such bending of said support arms

* * * * *